United States Patent [19]

Clatterbuck

[11] 4,095,730

[45] Jun. 20, 1978

[54] WRAPPING BRIDGE FOR A WRAP DISPENSING PACKAGE

[75] Inventor: Richard Thomas Clatterbuck, North Canton, Ohio

[73] Assignee: The Goodyear Tire & Rubber Company, Akron, Ohio

[21] Appl. No.: 826,501

[22] Filed: Aug. 22, 1977

[51] Int. Cl.[2] ..... B26F 3/02

[52] U.S. Cl. ..... 225/48; 225/53; 225/80; 225/90

[58] Field of Search ..... 225/25, 26, 47, 48, 225/53, 80, 90, 85; 242/55.2, 55.53

[56] References Cited

U.S. PATENT DOCUMENTS

| | | | |
|---|---|---|---|
| 3,227,340 | 1/1966 | Haley | 225/53 X |
| 3,477,624 | 11/1969 | Branyon et al. | 225/90 X |
| 3,521,800 | 7/1970 | Stephens et al. | 225/25 X |
| 3,679,110 | 7/1972 | Stine | 225/90 X |

*Primary Examiner*—Frank T. Yost
*Attorney, Agent, or Firm*—L. A. Germain

[57] ABSTRACT

A bridge structure that facilitates drawing and cutting of wrapping stock is formed from a panel embodying the package structure. The bridge is erected in a substantially upright position on the panel and is maintained in its position by a pair of legs in either of its ends that have foot portions engaging the panel through punch-out openings in the panel.

4 Claims, 4 Drawing Figures

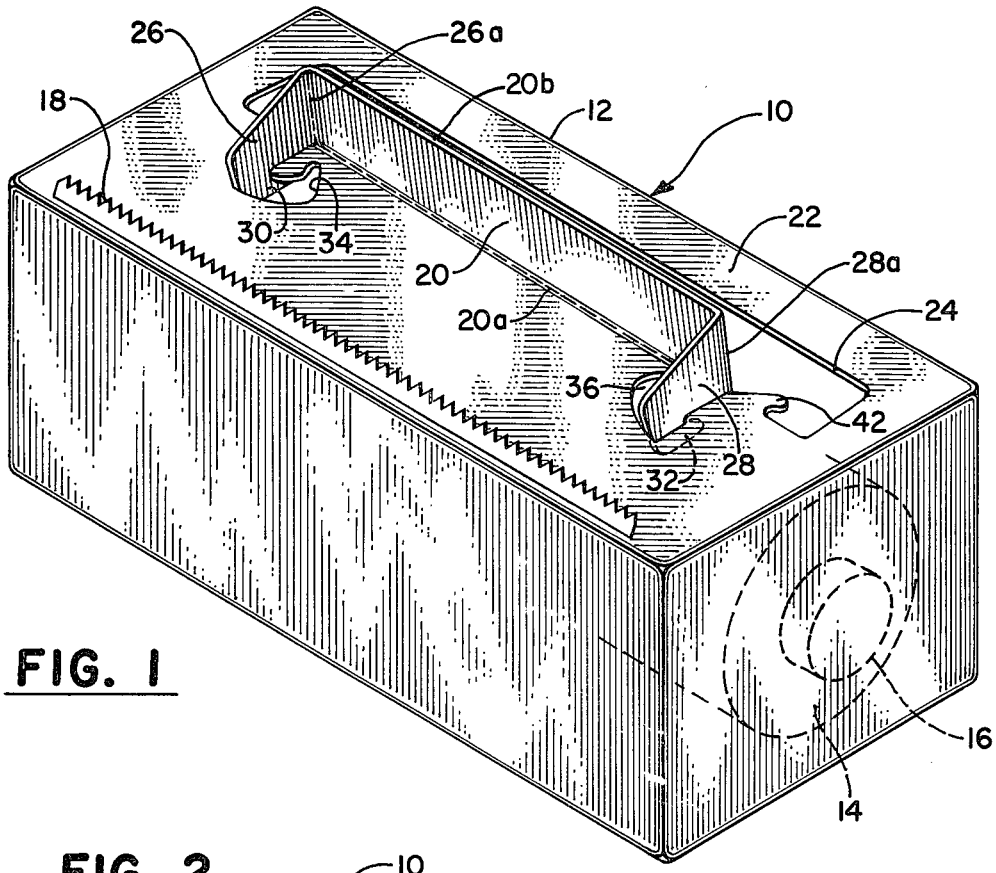
FIG. 1
FIG. 2
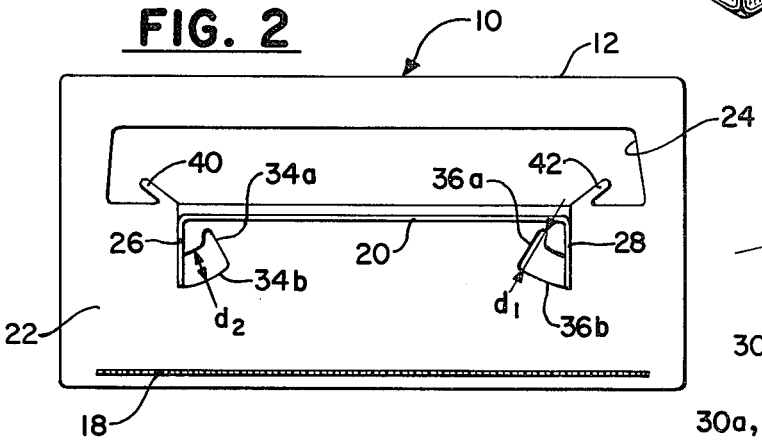
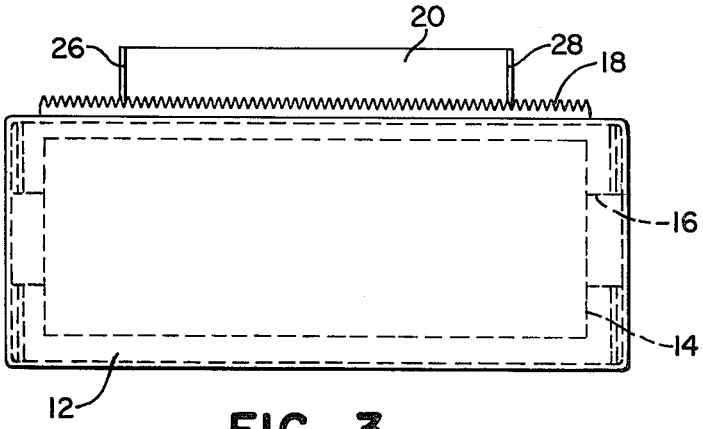
FIG. 3
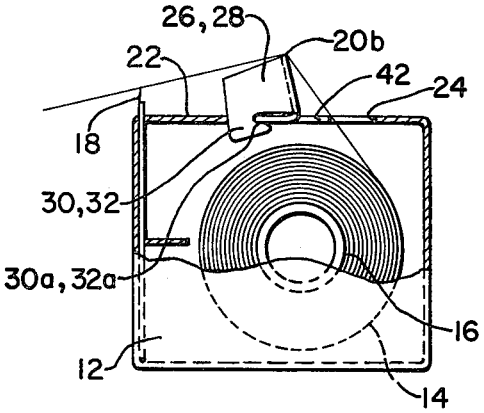
FIG. 4

WRAPPING BRIDGE FOR A WRAP DISPENSING PACKAGE

BACKGROUND OF THE INVENTION

This invention relates to dispensing packages containing rolled wrapping stock such as plastic film, metal foil, waxed paper and the like, and more particularly to a novel arrangement for a wrapping bridge that facilitates dispensing the wrap and cutting it to a desired length.

The satisfactory dispensing of sheet wrapping materials, particularly plastic wrapping film, has been a source of difficulty inasmuch as the film has a tendency to cling to the package from which it is being drawn. When the material clings, it is all but impossible to maintain a uniform edge on the free end of the roll upon being cut. Furthermore, the free end becomes inaccessible for continued drawing of subsequent lengths from the package unless care was taken as to the disposition of the free end during the cutting operation. In this circumstance, the drawing and cutting of such films has of necessity been a two hands operation and even at that, care must be exercised so that the next length of wrap may be in a proper position for drawing and cutting.

In view of these problems and other associated problems and disadvantages of presently used dispensing packages, it is an object of this invention to provide a novel arrangement for a wrapping bridge in conjunction with a wrap dispensing package such as to facilitate drawing and cutting of wrapping stock from the package in a smooth and efficient manner.

It is a further object of the invention to provide a wrapping bridge for a dispensing package that maintains an accessible position of the free end of the wrap upon being drawn and cut.

Another object of the invention is to provide a wrapping bridge that is part and parcel of the container blank from which the package is constructed and which upon being positioned by the consumer using the wrap, offers the possibility of a one hand drawing and cutting operation.

These objects and other objects and advantages of the invention are accomplished in a package adapted for dispensing rolled wrapping stock and having a knife-edge for cutting the stock upon being drawn from the package, a wrapping bridge erectable from a panel embodying the package to effect an angular relationship between stock and the knife-edge upon being drawn from an opening in the panel created by the bridge such that the stock is easily cut and the free end thereof maintained in an accessible position on the package, said bridge comprising a substantially rectangular body portion formed from the package panel by a first densely perforated line, which upon the bridge body being pressed or lifted effects its separation from the panel along the line formed by the perforations, and a second sparsely perforated line in a spaced parallel relationship to the first perforated line such as to form a hinge line upon lifting of the bridge body from the panel, and a pair of legs each attached at either end of the bridge body portion by a sparsely perforated hinge line that is perpendicular to the bridge body hinge line, the legs being formed by a densely perforated peripheral line that effects separation of the legs and thus the end portions of the bridge from the package panel and which upon being separated may be bent along their individual hinge lines in a direction substantially perpendicular to the bridge body to form stable rests for the uprighted bridge.

DESCRIPTION OF THE DRAWINGS

The features and advantages of the invention will become apparent from the description that follows when taken in conjunction with the accompanying drawings in which like reference numerals in the several figures indicate like elements and in which:

FIG. 1 is a perspective view of a wrap dispensing package illustrating the wrapping bridge forming the instant invention;

FIG. 2 is a top plan view of the package of FIG. 1;

FIG. 3 is a frontal elevational view of the package of FIG. 1; and

FIG. 4 is a side or end elevational view partially in section of the dispensing package of FIG. 1.

BRIEF DESCRIPTION OF THE INVENTION

Referring to the drawings, a wrap dispensing package is generally indicated by reference numeral 10 and conventionally comprises a rectangular shaped container 12 of a size to accommodate a particular width wrapping stock 14 by virture of the length of a roller 16 upon which the wrap is mounted. The container 12 is conventionally assembled from a flat, one-piece blank of heavy corrugated or regular cardboard stock which, by the ingenious use of slots and tabs, is interlocked to form end bearings for the roller 16 and a strong and substantially solid container for carrying the wrapping stock 14. The container 12 is usually designed for accessibility of the wrap by reason of a slot opening in the package top or side such as to facilitate drawing of the wrap from the roll and also includes an upraised tab having a knife edge 18 that extends outwardly from the package. The knife edge may be mounted from the top or a side but generally extends across the full width of the package such as to cover the width of wrapping stock contained therein. Containers of the type just described are well-known and used in the packaging industry and may be manufactured by any one of a number of companies including the Keystone Container Corporation, St. Louis, Mo.

This invention is concerned with providing a structure that is integral with the container or dispensing package 12 and which facilitates drawing and cutting of the wrapping material 14 contained therein. The structure takes the form of a bridge 20 that is a part of one side 22 of the package 12. While the drawing shows the bridge 20 as being formed from the top side of the package, it may as well be located on either side or the bottom, depending, of course upon the manner of positioning the package for dispensing the wrap 14. In any case, the bridge 20 is formed from a package panel 22 by closely perforating the cardboard along the line of the bridge configuration such that upon being depressed inwardly or pulled outwardly, the cardboard forming the bridge separates from the panel to create an opening in the panel such as at 24 of the drawing. Along one edge of the cardboard that forms the bridge 20 the perforations are spaced at longer intervals or may be in the form of a plurality of equally spaced slits such that a hinge line **20*a* is formed at the base of the bridge. Thus upon separating the closely perforated line in the panel 22 and lifting outwardly, the bridge 20 tends to bend on line 20*a*** to a substantially vertical position on the package. Of course, this cardboard forming and bending technique is a well-known and recognized procedure in the cardboard container industry.

To continue, the bridge 20 is maintained in a vertical orientation on the package by reason of a pair of legs 26,28 located on either end and which are formed by hinge-forming perforations 26*a* and 28*a*. Each leg 26,28 has a foot portion 30,32 respectively, formed in its cutout patten and which define slits 30*a*,32*a* having a gap that is at least equal to or greater than the thickness of the cardboard comprising the package. Now therefore, to provide for locking of the bridge in a vertical position, a pair of punch-outs 34,36 are formed in the panel 22 by closely perforating the entire periphery of the punchout pattern 34,36 and these are located at the ends of the bridge 20 in a relative position to the legs 26,28. The punchouts 34,36 are in the pattern configuration of the feet 30,32 at a point 34*a* and 36*a* closest to the bridge and have arcing portions 34*b*,36*b* tending away from the bridge 20. The arcing portions of the punchouts have a dimension "$d_1$" that approximates the width of each of the legs at the slits 30*a*,32*a* while the portion of the punchout closest to the bridge has a dimension $d_2$ that approximates the dimension of a foot 30,32. In this circumstance, and upon bending of the legs 26,28 inwardly i.e., toward each other, the feet 30,32 may be inserted into punchout portions 34*a*,36*a* such that the slits 30*a*,32*a* carry the thickness of the cardboard therebetween as the legs are turned outwardly i.e., away from each other to the point of termination of the arc portion of the punchout. The point of termination of the arcs 34*b*,36*b* will normally be on a line orthogonal with respect to the bridge such that the legs 26,28 are positioned in a substantially right-angled relationship with the bridge.

Thus it may be appreciated that the invention provides a bridge that is formed of a package panel, and may be easily erected by the consumer. Further, the bridge may be permanently left in the vertical position as long as the wrap is being drawn from the package or it may be turned to a laying-down position as originally found by disengaging the legs 26,28 from the panel 22. It will also be appreciated that the cutout pattern that the bridge makes in the panel 22 as defined by the edge 24 creates a pair of projections 40,42 that serve to hold the wrap away from the broad surface of the bridge so that the wrap is unable to cling to that surface. Thus upon being drawn from the package, the wrap is held in an accessible position by the knife edge 18, the bridge edge at 20*b*, and the projections 40,42. In this circumstance, a film wrap may be drawn and cut from the package in a one-hand operation and be ready from subsequent draws with a minimum of resistance from clinging of the wrap on broad areas of the package.

While certain representative embodiments and details have been shown for the purpose of illustrating the invention, it will be apparent to those skilled in this art that various changes and modifications may be made therein without departing from the spirit or scope of the invention.

What is claimed is:

1. In a package adapted for dispensing rolled wrapping stock and having a knife-edge for cutting the stock upon being drawn from the package, a wrapping bridge erectable from a panel embodying the package to effect an angular relationship between the stock and the knife-edge upon being drawn from an opening in the panel created by the bridge such that the stock is easily cut and the free end thereof maintained in an accessible position on the package, said bridge comprising a substantially rectangular body portion formed from the package panel by a first densely perforated line, which, upon the bridge body being pressed or lifted effects its separation from the panel along the line formed by the perforations, and a second sparsely perforated line in a spaced parallel relationship to the first perforated line such as to form a hinge line upon lifting of the bridge body from the panel, and a pair of legs each attached at either end of the bridge body portion by a sparsely perforated hinge line that is perpendicular to the bridge body hinge line, the legs being formed by a densely perforated peripheral line that effects separation of the legs and thus the end portions of the bridge from the package panel and which, upon being spearated, may be bent along their individual hinge lines in a direction substantially perpendicular to the bridge body to form stable rests for the uprighted bridge.

2. The wrapping bridge as set forth in claim 1 wherein the legs also comprise foot portions extending from the unhinged end thereof and the package panel includes densely perforated areas on the configuration of the foot portions on each leg, said areas located on the package panel at either end of the bridge and upon being removed from the panel form openings therein that accept the foot portions in a locking engagement such as to maintain the bridge in a substantially upright position on the package panel.

3. The wrapping bridge as set forth in claim 2 wherein the openings in the panel that engage the foot portions of the bridge have arching portions that terminate on a line perpendicular to the bridge, the foot portions of the openings being located closely to the bridge such that upon engaging the foot portions of the bridge in respective openings they may be pivoted outwardly from the bridge along the arch of the respective opening until each leg of the bridge is in perpendicular orientation with respect to the bridge.

4. The wrapping bridge as set forth in claim 3 wherein a pair of protrusions are formed in the opening created by the bridge upon its erection from the panel, said protrusions depending into the opening and in the plane of the panel such as to provide engagement surfaces with wrapping stock being drawn from the package through the opening.

* * * * *